United States Patent [19]

Pullin et al.

[11] 4,420,044

[45] Dec. 13, 1983

[54] FLOW CONTROL SYSTEM

[75] Inventors: William H. Pullin, Dallas; Olen R. Long, Celina, both of Tex.

[73] Assignee: Otis Engineering Corporation, Dallas, Tex.

[21] Appl. No.: 409,511

[22] Filed: Aug. 19, 1982

[51] Int. Cl.[3] ..... F21B 33/00

[52] U.S. Cl. ..... 166/322; 166/189; 166/323; 137/68 R; 137/71; 251/63.5; 251/73; 251/92; 251/230

[58] Field of Search ..... 137/68 R, 71, 624.13; 166/313, 319, 323, 322, 189; 251/63, 63.5, 67, 73, 92, 230

[56] References Cited

U.S. PATENT DOCUMENTS

| | | | |
|---|---|---|---|
| 1,898,899 | 2/1933 | Rowley | 137/68 R |
| 2,236,564 | 4/1941 | Cornell | 137/71 |
| 3,664,427 | 5/1972 | Deaton | 166/313 |
| 4,309,022 | 1/1982 | Reinicke | 251/73 X |

*Primary Examiner*—Harold W. Weakley
*Attorney, Agent, or Firm*—Vinson & Elkins

[57] ABSTRACT

A control valve for a passageway in which the valve is reciprocated toward and away from its seat by pressure within a pressure dome and pressure exteriorly of the valve housing and in which reciprocation is controlled by a J-slot capable of latching the valve in open position while being run and releasing the valve for reciprocation after being landed in the well together with a frangible disc which may be ruptured to permit flow past the valve member; said valve being used to control flow through a H mandrel in a pumpdown system.

2 Claims, 4 Drawing Figures

FLOW CONTROL SYSTEM

This invention relates to valves and particularly to a valve system useful for controlling cross flow in an H-mandrel of a pumpdown completion.

Pumpdown completions commonly utilize an H-mandrel with communication between the cross leg of the H controlled so that communication may be established between the two side legs of the H for circulation of a tool string and may be interrupted during production of the well. A disclosure of such pumpdown systems and tools to be used therein appears in a brochure of Otis Engineering Corporation entitled Pumpdown Completion Equipment and Services No. OEC 5113B. See also U.S. Pat. No. 3,664,427 showing one form of H-member and a form of control valve for the system. See U.S. application Ser. No. 214,726 filed Dec. 9, 1980 by Ronald Risinger for a form of control valve which may be latched in full open position.

As shown in said Otis catalog, valves may be pumped into and out of the well and landed in the H-member to control flow. In one popular completion method, the H-member includes a side pocket receptacle which receives a valve and the valve controls flow through the cross-member of H to open the cross-member for circulating tools and close the cross-member for production.

In one popular form of valve for this purpose, a pressure dome including a piston is utilized. The resilient seal between the piston and the housing will leak and pressure will be lost from the pressure dome while the valve is installed in the well. If the valve is held in closed position by dome pressure, such leakage may result in the valve unseating permitting cross flow in the H-member. Such cross flow is unacceptable where dual formations are being produced.

An object of this invention is to provide a flow control system and a flow valve for use in a pumpdown completion H-member in which dome pressure against a resilient seal is utilized to permit reciprocation of the valve between open and closed position in response to external fluid pressure conditions and in which once opened, the valve is latched in the open position.

Another object is to provide a flow control system and valve as in the preceding object in which a flowway is provided across the seal area of the valve member and a frangible member controls flow through the flowway so that upon rupture of the frangible member, cross flow between the two upright legs of the H-member is established to permit pumping a tool train into and out of the well to retrieve the valve.

Other objects, features and advantages of the invention will be apparent from the drawings, the specification and the claims.

In the drawings wherein like numerals indicate like parts and wherein an illustrative embodiment of the this invention is shown:

The valve system of this invention may be utilized in any circumstance in which circulation is desired such as a side door or H-member configuration. In the illustrative embodiment of the invention, it will be discussed as applicable to functioning as a circulation control valve of an H-member.

Figure 1:
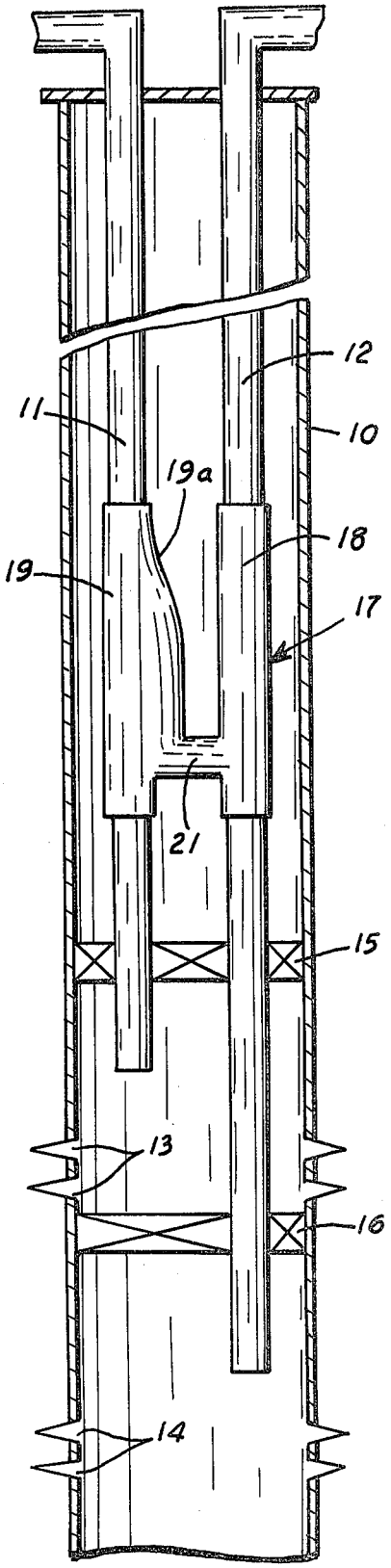
FIG. 1 is a schematic view in elevation of a well completed for dual production with an H-member for establishing communication between the two tubings when pumping a tool train into or out of the well.

A conventional pumpdown dual completion is shown in FIG. 1. The casing 10 has supported therein parallel tubing strings 11 and 12. The casing is perforated at 13 and 14 and packers 15 and 16 packoff about the tubing and isolate the two formations from each and from the annulus above the upper packer 15. The tubing 12 extends below packer 16 to provide for production from perforations 14 and the tubing 11 terminates between the two packers 15 and 16 to provide for production from perforations 13. The H-member indicated generally at 17 has the two parallel legs 18 and 19 interconnected by the cross-member 21. The H-leg 19 is provided with a side pocket **19*a* for landing of a valve as will be explained hereinafter. The valve will be utilized to open and close communication between the two parallel legs 18 and 19** of the H-member to provide for production when closed and for pumping of tool trains into and out of the well when opened.

Figure 2:
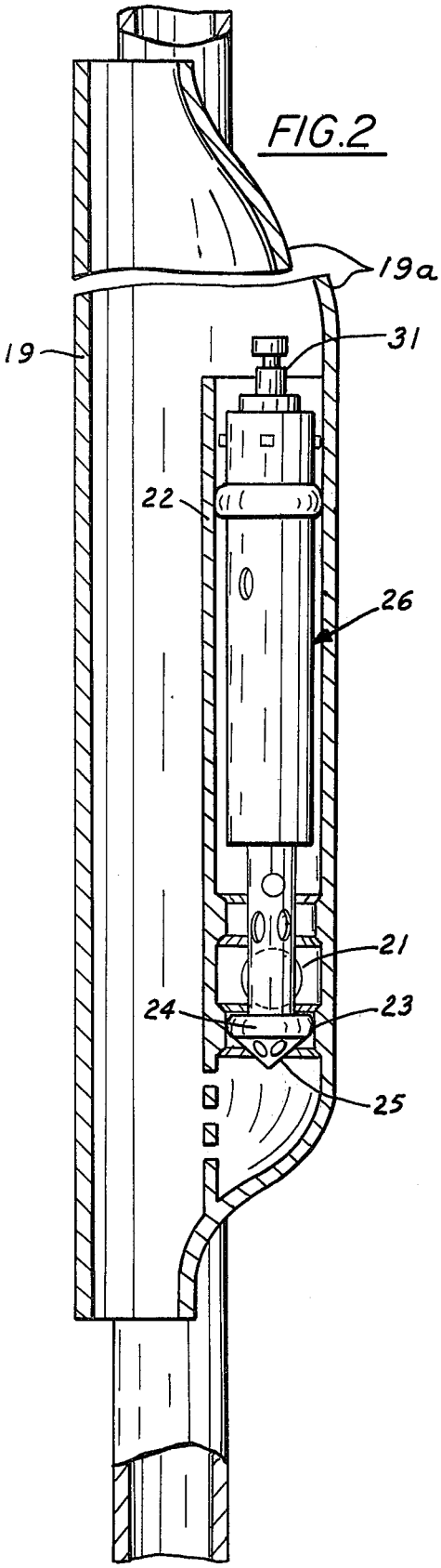
FIG. 2 is a schematic view partly in elevation and partly in cross-section of an H-member having landed therein a valve constructed in accordance with this invention which cooperates with the valve seat provided by the H-member to control flow.

In FIG. 2, the leg 19 of the H-member is shown in section to include in the pocket 19 the receptacle 22 for receiving a valve. In the lower end of the receptacle, a seat 23 is provided which cooperates with the seal means 24 on the valve member 25 of the valve indicated generally at 26 to control flow through the cross-member 21 of the H-member 17. When the valve member 25 is extended as shown in FIG. 2, flow through the cross-member 21 is prohibited.

Figure 4:
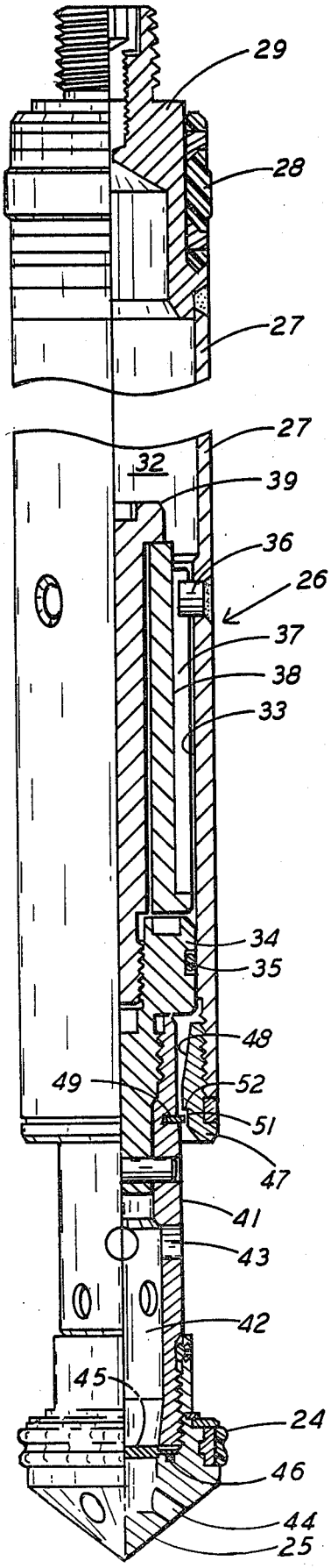
FIG. 4 is a view partly in elevation and partly in section of a valve constructed in accordance with this invention.

Referring now to FIG. 4, details of the valve are shown. The valve includes a body 27 having at its upper end packing 28 carried by an upper sub 29 which has provisions at its upper end for attachment to a conventional latch 31 shown in FIG. 2.

In the body there is provided a pressure dome 32 which is charged with fluid under pressure. At its lower end, the body is provided at 33 with a cylindrical surface which slidably receives the piston 34 carrying the resilient seal such as O-ring 35. The piston 34 is exposed on one side to pressure within the dome and on the other side to pressure exterior of the body. The pressure dome is charged with a selected fluid to a selected pressure level and changing of pressure exterior of the body, that is, in the two tubings 11 and 12, is utilized to reciprocate the piston within the cylinder 33.

The body and piston carry cooperable pin and J-slot means for alternately latching the piston in retracted position and permitting the piston to extend in response to external pressure conditions. The body carries the pins which preferably are three in number one of which is shown at 36. These pins cooperate with the J-slot shown in FIG. 3. In the drawings, the pin 36 is shown in the long leg 37 of the J-slot with the valve member 25 in fully extended position. While the valve is being run, the valve member 25 is in retracted position and is held in this retracted position by cooperation of the pin and the J-slot being located in the **36*a* position. After the valve is landed, the tubing is pressured up to move the J-slot and pin to the relative position shown at 36*b* in dashed lines. Thereafter, a reduction of pressure in the tubing will permit the valve to close with the pin 36 in the slot 37 shown in FIGS. 3 and 4. The J-slot may be provided in an annular sleeve member 38 secured to piston 34 by the shoulder screw 39**.

The valve member 25 is carried by the piston 34 on a tubular sleeve 41 secured to the piston and to the valve member by any desired means such as the threaded connection shown so that the sleeve provides a part of the valve member.

To provide for flow past the seal 24 of the valve member, the tubular sleeve 41 has a flowway 42 therein which communicates with side ports 43 in the sleeve and with ports 44 in the valve member to permit fluid to by-pass the seal area provided by the seal means 24 on the valve member 25.

To block flow of fluid between the ports 43 and 44, a frangible seal disc extends across the fluid passageway 42 and seal means such as O-ring 46 seal between the frangible disc and the valve member to prevent flow through the fluid passageway 42.

A cooperable split ring and shoulder means are carried by the body and by the piston which engage when the valve member is extended to lock the valve member in extended position. In the illustrated form, the body has at its lower end a retaining nut 47 which has an upwardly and outwardly inclined bore 48 in its upper end. At its lower end, the bore through the nut is enlarged to provide a downwardly facing shoulder 52 against which the snap ring 49 which is carried in the sleeve 41 will abut and prevent the valve member from returning to its retracted position.

When the valve member 25 is in its retracted position, the split ring 49 is positioned above the nut 47. When the cooperating J-slot and pin 36 are arranged so that the pin 36 is within the long leg 37 of the J, the valve may be extended by reducing the external pressure on the piston 34. As the piston 34 moves down, the split ring 49 will engage the frusto conical bore 48 of nut 47 be compressed into its ring until it passes into the enlarged diameter portion 51 of the nut 47. At that time, the split ring will spring outwardly and will prevent upward movement of the valve member 25 by engaging the shoulder 52 provided by the enlarged diameter portion 51 of the nut.

Figure 3:
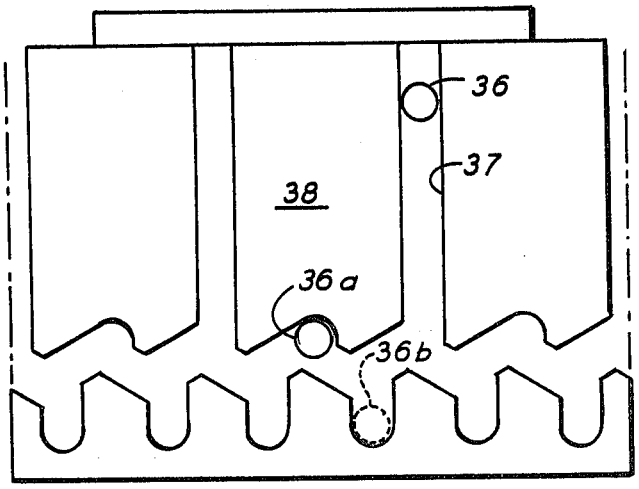
FIG. 3 is a development of the slot and pin providing the J-slot utilized by the valve of this invention.

In operation, the valve will be dressed and the pin 36 positioned in the short leg of the J as shown as **36*a* in FIG. 3. With a suitable dome pressure, the J-slot sleeve will be driven downwardly with the piston 34 to firmly engage the pin 36 and the valve will be held in the retracted position. The valve will be run on a suitable pumpdown train and landed in the side pocket as shown in FIG. 2. Thereafter, the train may be released from the valve and utilized to perform other functions in the well. After carrying out such operations as desired in which the flowway 21 will remain open with the valve member 25 in up and non-seated position, the valve can be closed by increasing the pressure in the tubings to force the piston and J-slot upwardly until the pin 36 assumes the 36*b* position. Thereafter reducing the pressure in the tubings will permit the J-slot and piston to move downwardly with the pin 36 in slot 37 until the valve is in fully closed position as shown in FIG. 4. At this time, the seal 24 on the valve member will engage the seat 23 in the H-member and will close off communication through the flowway 21 to permit the two formations to be produced without comingling of fluids. In the event that pressure is lost within the pressure dome, the valve cannot move to closed position as with the loss of pressure, the snap ring 49 will move into engagement with the shoulder 52 and prevent further upward movement of the valve member to lock the valve in full extended position. Thus, the snap ring will ensure that the flowway 21** will always be closed.

Of course, some time will be required for any leakage across the piston seal 35 to reduce the piston seal to a level at which the valve member 25 would move off of its seat. Thus, in the valve shown where it is known that the valve will be pulled at frequent periodic intervals, the snap ring 49 may be omitted and the tubing pressured up to move the valve member to closed position and latch it in the closed position in the J-slot to thereafter pull the valve and carry out such other procedures as are desired. While the valve is pulled, the pressure within the dome can be checked to be sure that it is at a proper level before the valve is rerun. In those instances where frequent periodic operations are not expected to be carried out, the latch provided by the split ring will be employed and when the well is placed on production, the valve member 25 will be locked in the full open position.

When it is desired to thereafter carry out any operations in the well, the tubing pressure is increased to a value at which the shear disc 45 will be ruptured to provide for communication between the two tubings 11 and 12. With such communication, the tool train can be run in to retrieve the valve, redress it, check the dome pressure and after the desired procedures are completed, the valve may be rerun and again extended to engage the seat 23 and block flow through the flowway 21.

The foregoing disclosure and description of the invention are illustrative and explanatory thereof and various changes in the size, shape and materials, as well as in the details of the illustrated construction may be made within the scope of the appended claims without departing from the spirit of the invention.

What is claimed is:

1. A flow control system comprising; a mandrel having a flowway, a valve seat across said flowway, and means in said mandrel for receiving a retrievable valve in said means; a control valve comprising, a body, a pressure dome in said body, a piston slidable in said body and exposed to pressure within said dome on one side and to pressure exterior of the body on the other side, resilient seal means between said piston and body, said body and piston having cooperable means for alternately latching said piston in retracted position and permitting said piston to extend in response to external pressure conditions, a valve member carried by said piston and having a seal area cooperable with said valve seat to control flow through said flowway, said member having a fluid passageway communicating with the exterior of the valve member on opposite sides of the valve member seal area, a frangible disc sealing said fluid passageway, and cooperable split ring and shoulder means carried by said body and piston engaging when said valve means is extended to lock said valve member in extended position.

2. A control valve comprising, a body, a pressure dome in said body, a piston slidable in said body and exposed to pressure within said dome on one side and to pressure exterior of the body on the other side, resilient seal means between said piston and said body, said body and piston having cooperable means for alternately latching said piston in retracted position and permitting said piston to extend in response to external pressure conditions, a valve member having a seal area carried by said piston, said valve member having a fluid passageway communicating with the exterior of the valve member on opposite sides of the valve member seal area, a frangible disc sealing said fluid passageway, and cooperable split ring and shoulder means carried by said body and piston engaging when said valve means is extended to lock said valve member in extended position.

* * * * *